US007976293B2

(12) United States Patent
Kusano

(10) Patent No.: US 7,976,293 B2
(45) Date of Patent: Jul. 12, 2011

(54) CENTRIFUGAL FAN

(75) Inventor: Hideki Kusano, Osaka (JP)

(73) Assignee: Nidec Corporation, Kyoto (JP)

( * ) Notice: Subject to any disclaimer, the term of this patent is extended or adjusted under 35 U.S.C. 154(b) by 621 days.

(21) Appl. No.: 12/044,180

(22) Filed: Mar. 7, 2008

(65) Prior Publication Data

US 2008/0219838 A1 Sep. 11, 2008

(30) Foreign Application Priority Data

Mar. 8, 2007 (JP) ..... 2007-058194

(51) Int. Cl.
*F04B 35/04* (2006.01)

(52) U.S. Cl. ..... 417/423.7; 417/423.1; 417/423.14

(58) Field of Classification Search ..... 417/423.1, 417/423.7, 423.14
See application file for complete search history.

(56) References Cited

U.S. PATENT DOCUMENTS

| | | | | |
|---|---|---|---|---|
| 4,164,690 | A * | 8/1979 | Muller et al. | 318/400.41 |
| 5,979,541 | A * | 11/1999 | Saito | 165/80.3 |
| 6,400,053 | B1 * | 6/2002 | Horng | 310/91 |

FOREIGN PATENT DOCUMENTS

| | | | |
|---|---|---|---|
| JP | 07-046811 | A | 2/1995 |
| JP | 2001-135964 | A | 5/2001 |
| JP | 2001-241395 | A | 9/2001 |
| JP | 2002-291194 | A | 10/2002 |
| JP | 2005-083244 | A | 3/2005 |
| JP | 2005-291157 | A | 10/2005 |

* cited by examiner

*Primary Examiner* — Devon C Kramer
*Assistant Examiner* — Peter J Bertheaud
(74) *Attorney, Agent, or Firm* — Keating & Bennett, LLP

(57) ABSTRACT

A centrifugal fan includes an impeller having a plurality of blades around a predetermined central axis, a motor that rotatably drives the impeller, a control circuit that controls the rotation of the motor, and a casing that houses the impeller, the motor, and at least a portion of the control circuit. A plurality of electronic components of the control circuit are disposed in an electronic component mounting portion provided between a circumferential wall of the casing and a virtually extending plane of an opening end surface of an exhaust port along a direction substantially perpendicular to the central axis. In the centrifugal fan, the electronic components are disposed radially outside an air passage, and thus the centrifugal fan can be reduced in its axial size, so that downsizing of the fan can be achieved.

7 Claims, 3 Drawing Sheets

CENTRIFUGAL FAN

BACKGROUND OF THE INVENTION

1. Field of the Invention

The present invention relates to electric centrifugal fans.

2. Description of the Related Art

Hybrid cars and electric cars, which utilize a driving force developed by motors for vehicle propulsive power, have gained more and more attention in recent years. These vehicles are typically equipped with rechargeable batteries which store electric energy to be used for driving the motors. Since the batteries, however, have internal resistance, heat is generated when power is charged or discharged. The repeated charging/discharging causes the temperature to rise in the batteries. Continued use of the batteries during high temperature conditions causes a shortening of the life of the batteries, and the batteries therefore require cooling. In order to cool the batteries, centrifugal fans have conventionally been used.

For installing a centrifugal fan in a vehicle, it is desirable to design the space for disposing the batteries and the centrifugal fan for cooling the batteries to have the smallest possible size so that a large cabin space and cargo space can be achieved.

Regarding conventional centrifugal fans, there is known a structure in which, e.g., high heat generating power devices (electronic components containing a control circuit of the motor) are attached to a surface that is opposite to the surface in which the intake port of the casing is provided. With this structure, heat generated in the power devices can effectively be dissipated to the casing.

With the conventional structure, however, the centrifugal fan has a considerable size. When such a conventional centrifugal fan is installed in a vehicle, it becomes difficult to achieve a large cabin space and cargo space.

This kind of problem is not unique to the cooling fans for the batteries mounted in vehicles, but may occur in other apparatuses with centrifugal fans for cooling heat-generating parts, such as electronic devices that are required to have a minimal size and thus there is limited installation space for the centrifugal fans.

SUMMARY OF THE INVENTION

In order to overcome the problems described above, a centrifugal fan according to a preferred embodiment of the present invention preferably includes an impeller, a motor, a control circuit, and a casing. The impeller includes a plurality of blades arranged around a central axis. The motor rotates the impeller about the central axis. The control circuit preferably includes a circuit board and a plurality of electronic components mounted on the circuit board, and controls the rotation of the motor. The casing houses the impeller, the motor, and a portion of the control circuit.

The casing preferably includes an intake port, an exhaust port, and a circumferential wall. The intake port preferably opens in an axial direction. The exhaust port preferably extends away from the central axis and has an opening end surface that is substantially parallel to the central axis. The circumferential wall surrounds the impeller.

The circumferential wall is arranged such that the radial distance between the outer periphery of the impeller and the circumferential wall gradually increases in a circumferential direction.

The circuit board is preferably disposed on the opposite side to the intake port of the impeller. At least a portion of the circuit board is exposed in a space between the circumferential wall and a virtual plane defined by extending the opening end surface of the exhaust port in a direction substantially perpendicular to the central axis. The portion of the circuit board exposed in the space has an electronic component mounting portion in which at least a portion of each of the plurality of electronic components are disposed.

The centrifugal fan according to the various preferred embodiments of the present invention enables a reduction in the thickness of the centrifugal fan.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
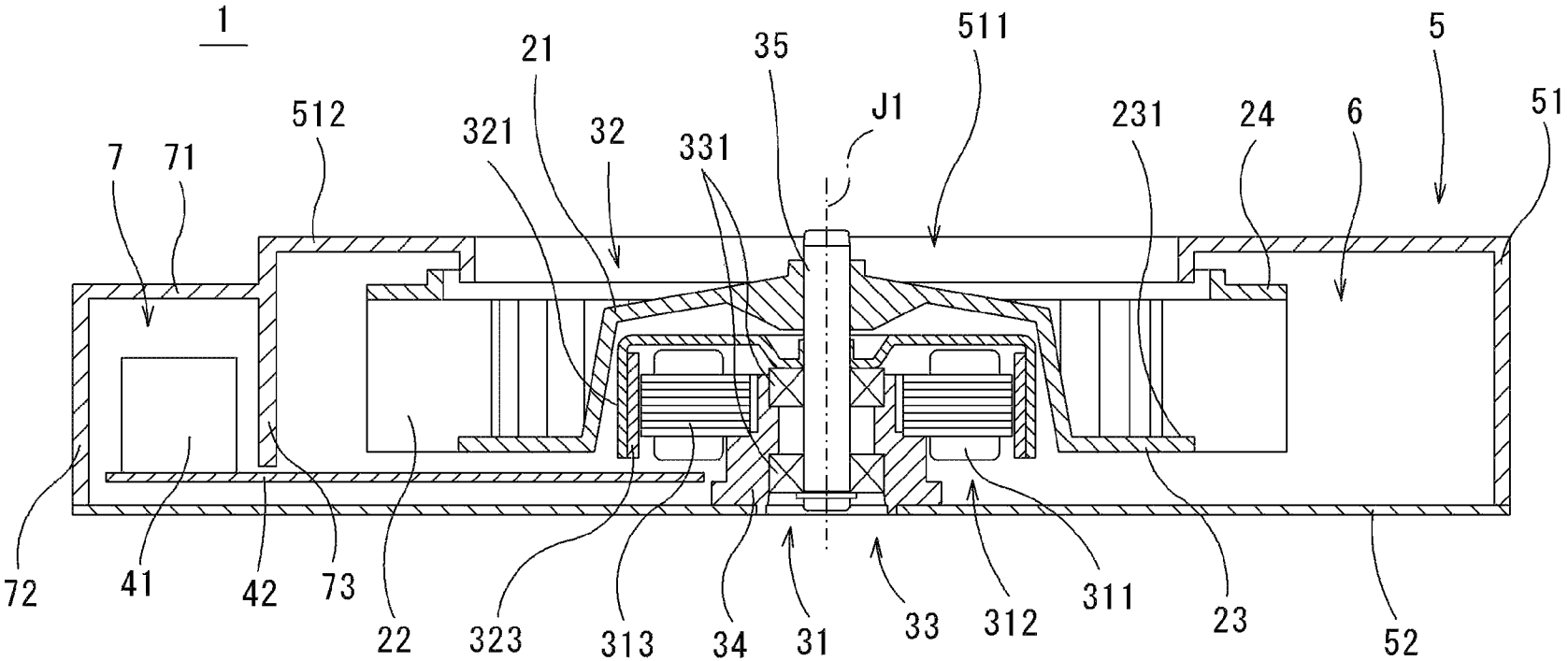
FIG. 1 is a schematic cross-sectional view of a centrifugal fan according to a preferred embodiment of the present invention.
Figure 2:
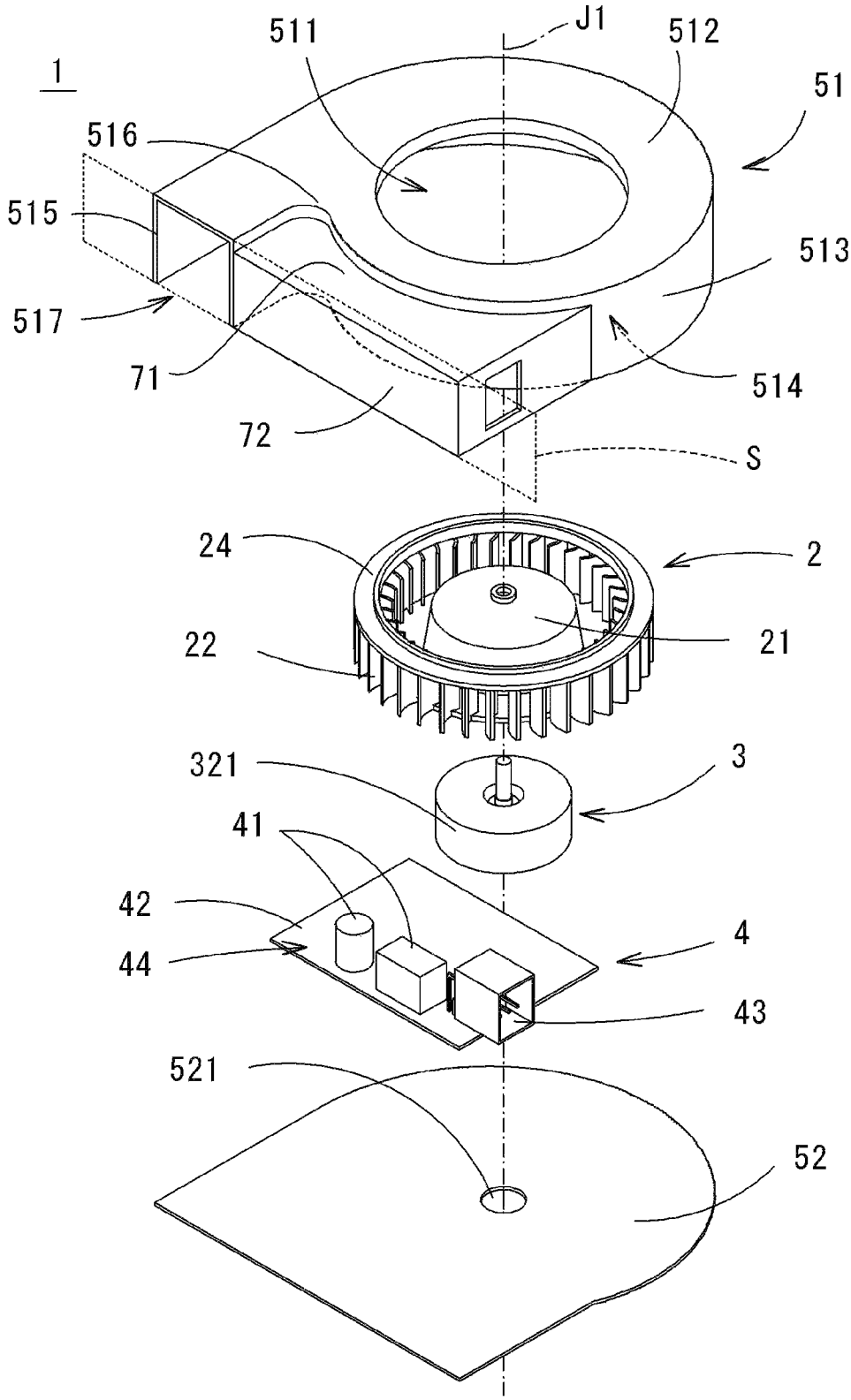
FIG. 2 is an exploded perspective view of the centrifugal fan according to the preferred embodiment of the present invention shown in FIG. 1.
Figure 3:
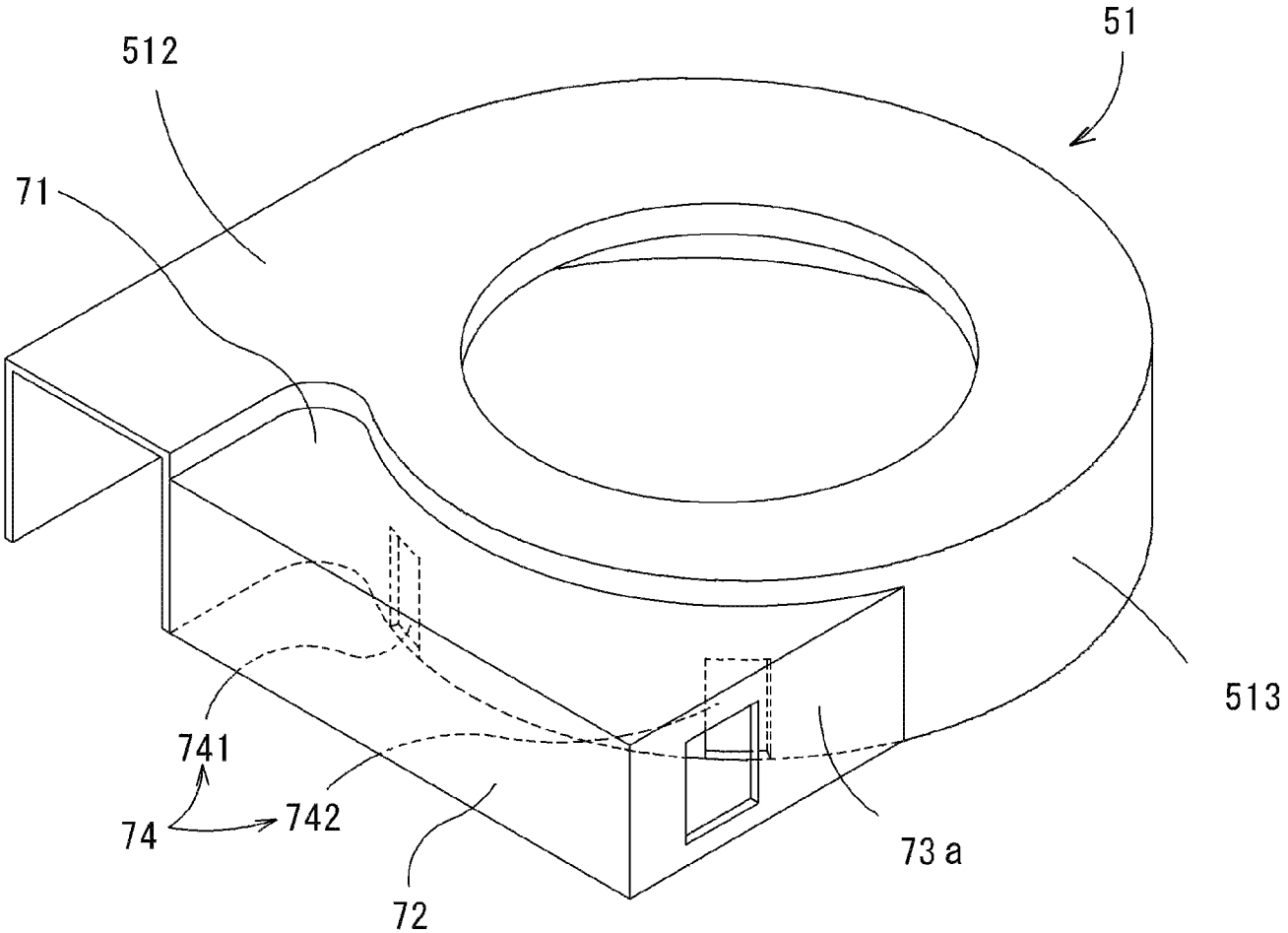
FIG. 3 is a schematic view of another exemplary casing main body according to another preferred embodiment of the present invention.

Referring to FIGS. 1 through 3, preferred embodiments of the present invention will be described in detail. It should be noted that in the explanation of the preferred embodiments of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction substantially parallel to a rotation axis, and a radial direction indicates a direction substantially perpendicular to the rotation axis.

A centrifugal fan according to a preferred embodiment of the present invention will be described below with reference to the drawings. FIG. 1 is a schematic cross-sectional view of a centrifugal fan 1 according to a preferred embodiment of the present invention, taken along a plane including its central axis J1. FIG. 2 is a perspective view showing main structural components of the centrifugal fan 1 in an exploded manner.

The centrifugal fan 1 includes an impeller 2, a motor 3, a control circuit 4, and a casing 5. The motor 3 rotates the impeller 2. The control circuit 4 controls the rotation of the motor 3. The casing 5 controls an airflow produced by the rotation of the impeller 2 to blow the air out of the casing 5. The casing 5 houses the impeller 2, the motor 3, and a portion of the control circuit 4.

Referring to FIG. 2, the casing 5 includes a casing main body 51 and a base 52. The casing main body 51 has an upper wall 512 provided with an intake port 511, a circumferential wall 513 surrounding the impeller 2, and an opening 514 axially opposite the upper wall 512. The casing main body 51 further has an exhaust port 515. The exhaust port 515 is arranged to protrude radially outward from a tongued portion 516 where the impeller 2 and the circumferential wall 513 are closest to each other. The casing main body 51 preferably is formed into a scroll such that the width of a passage 6 for the airflow formed between the circumferential wall 513 and the impeller 2, i.e., a radial distance between the outer periphery of the impeller 2 and the circumferential wall 513 is gradually increased toward the exhaust port 515. The base 52 as a sealing member closes the opening 514 to define the air passage 6 together with the casing main body 51 and the impeller 2.

In this preferred embodiment, the base 52 is preferably made from a metal plate, such as a steel plate, into an approximately flat shape through press working. The base 52 is disposed on approximately the same plane as the opening 514. A through hole 521 is provided at approximately the center of the base 52. Since the base 52 is preferably made of metal such as a steel plate, it is possible to effectively dissipate heat from the motor 3 and from a plurality of electronic components 41 of the control circuit 4 to the outside. Also, since the base 52 is preferably made from a metal plate through press working in the present preferred embodiment, the axial size of the centrifugal fan 1 can be reduced, which contributes to an overall reduction in the thickness of the apparatus.

The motor 3 includes a stator portion 31 and a rotor portion 32. The rotor portion 32 is supported by a bearing mechanism 33 relative to the stator portion 31 in a rotatable manner about the central axis J1.

The stator portion 31 includes a bearing holding portion 34 and a stator 312. The bearing holding portion 34 is inserted into the through hole 521 in the base 52. The stator 312 is fixed to the outer periphery of the bearing holding portion 34. Ball bearings 331 defining the bearing mechanism 33 are disposed radially inside the bearing holding portion 34 on the upper and lower sides in the axial direction. The stator 312 has a stator core 313 defined by a plurality of laminated thin plates, and a coil 311 prepared by winding conductive wires around the stator core 313 in the present preferred embodiment.

The rotor portion 32 includes a shaft 35, a rotor yoke 321, and a magnet 323. The impeller 2 is fixed to the shaft 35. The rotor yoke 321 has an approximately cylindrical shape centered about the central axis J1 with its opening oriented axially downward. The magnet 323 is fixed on the inner side surface of the rotor yoke 321.

The shaft 35 is inserted into the bearing holding portion 34 and is supported by the ball bearings 331 in a rotatable manner. The rotor yoke 321 is press-fitted onto the shaft 35 to be rotated integrally with the shaft 35. In the centrifugal fan 1, a plurality of electronic components 41 electrically connected to the coil 311 are mounted on a circuit board 42. The electronic components 41 control the current supply to the coil 311, thereby generating torque around the central axis J1 through the interaction between the stator 312 and the magnet 323. As a result, the shaft 35 and the impeller 2 attached thereto are rotated about the central axis J1.

The control circuit 4 preferably includes the circuit board 42, the electronic components 41, and a connector 43. In the present preferred embodiment, the circuit board 42 preferably has a substantially rectangular shape, for example. The circuit board 42 is arranged between the stator 312 and the base 52. The electronic components 41 are mounted on the circuit board 42 and control the current supply to the coil 311. The connector 43 connects the electronic components 41 to an external power supply or the like. The electronic components 41 include at least a large-volume device such as a capacitor and a noise reducing coil.

The impeller 2 includes a cup 21, a plurality of blades 22, a coupling plate 23, and an approximately annular portion 24. The cup 21 has an approximately cylindrical shape with its opening oriented downward and is fixed to the axially upper end of the shaft 35. The blades 22 are arranged annularly about the central axis J1 radially outside the cup 21. The coupling plate 23 is coupled with the axially lower ends of the blades 22. A coupling plate 23 is arranged to stretch radially outward from the axially lower end of the cup 21. The annular portion 24 is coupled with the axially upper ends of the blades 22. Each of the blades 22 extends from the upper surface 231 of the coupling plate 23 about the central axis J1, while the upper end of each blade 22 is coupled to the annular portion 24. In the present preferred embodiment, the cup 21, the blades 22, the coupling plate 23, and the annular portion 24 are integrally molded from a resin or plastic, for example.

The rotation of the impeller 2 induces air to be drawn through the intake port 511 into the casing 5. The air that is taken into the casing 5 is driven radially outward by the blades 22 and inside the air passage 6. The air is then blown against the circumferential wall 513 and the like of the casing 5, whereby the inner pressure of the casing 5 increases to the point where the air is discharged from the exhaust port 515 to the outside of the casing 5.

The circuit board 42 is preferably fixed on the side of the exhaust port 515 over the base 52 so as not to overlap with the through hole 521 in the base 52. At this point, the circuit board 42 is disposed such that a portion of the circuit board 42 is exposed at the radially outer side of the circumferential wall 513 of the casing 5. In this configuration where the circuit board 42 does not axially overlap with the through hole 521, there is no need to provide a hole in the circuit board 42 to allow penetration of a portion of the bearing holding portion 34 therethrough, so that the circuit board 42 can have a small size without wasting space. A plurality of circuit boards are typically manufactured from one metal sheet. According to a preferred embodiment of the present invention, since the circuit board 42 preferably has an approximately rectangular shape, a larger number of circuit boards can be made from one sheet in the manufacturing process of the circuit boards. Accordingly, it becomes possible to reduce the manufacturing costs for the circuit board 42.

In the present preferred embodiment, the electronic components 41 of the control circuit 4 are mounted on a component mounting portion 44 in the circuit board 42 by soldering, for example. The component mounting portion 44 is defined at a portion of the upper surface (axially upper surface) of the circuit board 42, which portion is preferably disposed in a space 7 between the circumferential wall 513 and a virtually extended plane S of an opening end surface 517 of the exhaust port 515 along a direction substantially perpendicular to the central axis J1. That is, the component mounting portion 44 is provided at an exposed portion of the circuit board 42 within the space 7 that is located radially outside the air passage 6 and adjacent to the exhaust port 515 and the tongued portion 516. The space 7 in which the electronic components 41 are disposed is enclosed with a top plate 71 and sidewalls 72. The top plate 71 and the sidewalls 72 are preferably formed integrally with the casing main body 51. A portion of the sidewall 72 forms a dividing wall 73 that also coincides with the circumferential wall 513 of the casing main body 51. The dividing wall 73 separates the air passage 6 from the space 7. The electronic components 41 are disposed in the space 7 which is surrounded by the top plate 71, the sidewalls 72, the dividing wall 73, and the base 52, which makes it possible to protect the space 7 from dust, water, and the like intruding from the outside.

As described above, the space 7 is surrounded by the exhaust port 515 protruding radially outward and the circumferential wall 513 of the casing main body 51. Therefore, the space 7 is a dead space which is unavailable as the air passage 6. By disposing the electronic components 41 including large-volume devices such as a capacitor and a noise removing coil in this dead space, it becomes possible to eliminate the need to mount many electronic components on the lower surface (axially lower surface) of the circuit board 42 as in conventional fans, which enables a reduction in the thickness of the centrifugal fan 1. Moreover, as inexpensive electronic components having large volumes can be put into use, the manufacturing cost of the centrifugal fan 1 can be advantageously reduced.

It should be noted that the space 7 is not necessarily enclosed by the top plate 71 and the sidewalls 72. For instance, by eliminating the top plate 71, the replacement of electronic components 41 is facilitated, and the heat dissipating properties can be improved.

In addition to the electronic components 41, the circuit board 42 is provided with the connector 43 for connecting the control circuit 4 to an external power supply (not shown) such as a battery. A portion of the connector 43 is arranged such that it is exposed to the outside from a through hole provided in a sidewall 72.

Since the portion of the connector 43 is exposed to the outside from the sidewall 72, a lead wire (not shown) connecting the connector 43 to the external power supply can extend in a radial direction, which makes it possible to reduce the axial size of the centrifugal fan 1, and consequently a centrifugal fan 1 with a reduced thickness can be achieved.

In the centrifugal fan 1 in the foregoing preferred embodiments, the air passage 6 and the space 7 mounted with the electronic components 41 are partitioned by the dividing wall 73. However, as shown in FIG. 3, it is possible to use a dividing wall 73*a* with which a ventilation device 74 is provided so as to pass air in and out between the air passage 6 and the space 7. The ventilation device 74 includes an inlet 741 and an outlet 742. Air flowing from the upper side of the air passage 6 passes through the inlet 741 into the space 7. The air goes out of the space 7 through the outlet 742 to merge into the lower side of the air passage 6. In this configuration, the electronic components 41 disposed in the space 7 can more efficiently be cooled.

Further, the centrifugal fan 1 in the foregoing preferred embodiments has a structure in which a portion of the connector 43 is exposed to the outside from a sidewall 72 that is not adjacent to the exhaust port 515. However, the portion of the connector 43 may be exposed to the outside from a sidewall 72 that is adjacent to the exhaust port 515. Also in this structure, the lead wire can extend in the radial direction, so that the centrifugal fan 1 can be reduced in its axial size. The arrangement of the connector 43 can be appropriately selected in consideration of, e.g., the direction in which the lead wire extends from the centrifugal fan 1.

Moreover, the circuit board 42 in the centrifugal fan 1 according to the foregoing preferred embodiments is preferably arranged in a substantially rectangular shape. The circuit board 42, however, may be arranged a substantially square shape.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A centrifugal fan comprising:

an impeller including a plurality of blades arranged about a center axis;

a motor arranged to rotate the impeller about the center axis;

a control circuit arranged to control the motor and including a circuit board, a plurality of electronic components mounted on the circuit board, and a component mounting portion on which at least one of the electronic components is mounted; and a casing arranged to house the impeller, the motor, and a portion of the control circuit; wherein the casing includes an axially arranged intake port, an exhaust port arranged to extend away from the center axis and having an opening end surface parallel or approximately parallel to the center axis, and a circumferential wall surrounding the impeller;

the circumferential wall is arranged such that a radial distance of the circumferential wall from an outer periphery of the impeller gradually increases in a circumferential direction;

the circuit board is arranged on an axial lower side of the impeller opposite to the intake port and the circuit board is also arranged entirely on an exhaust port side of the centrifugal fan with respect to the center axis such that an imaginary straight line may extend radially through the center axis and will not pass through any portion of the circuit board; and at least a portion of the circuit board is disposed in a space between a virtual plane extending from the opening end surface and the circumferential wall, and the component mounting portion is disposed in the space; wherein all of said electronic components mounted on the circuit board are disposed within said space; and wherein the component mounting portion is enclosed by sidewalls and a top plate, the sidewalls are parallel or substantially parallel to the center axis, the to plate is continuous with an upper wall of the casing, and the sidewalls and the to plate are integral with the casing.

2. The centrifugal fan according to claim 1, wherein the circuit board is approximately square or approximately rectangular.

3. The centrifugal fan according to claim 1, wherein the casing includes the upper wall being continuous with the circumferential wall and comprising the intake port; the casing further including an opening axially opposed to the upper wall, wherein the opening is closed with a sealing member.

4. The centrifugal fan according to claim 3, wherein the sealing member is substantially flat and arranged on approximately the same plane as the opening.

5. The centrifugal fan according to claim 3, wherein the sealing member is a pressed metal plate.

6. The centrifugal fan according to claim 1, wherein one of the sidewalls is a dividing wall, which also defines a portion of the circumferential wall of the casing.

7. The centrifugal fan according to claim 1, wherein one of the sidewalls is provided with a connector arranged to connect the control circuit to an external power supply.

* * * * *